US006739913B2

(12) United States Patent
Hayashi

(10) Patent No.: US 6,739,913 B2
(45) Date of Patent: May 25, 2004

(54) CONNECTOR ASSEMBLY FOR IGNITER SYSTEM AND SHORTING ASSEMBLY

(76) Inventor: Toshiaki Hayashi, 3-25-11 Shiratori, Tougoucho, Aichi (JP), 470-0155

( * ) Notice: Subject to any disclaimer, the term of this patent is extended or adjusted under 35 U.S.C. 154(b) by 0 days.

(21) Appl. No.: 10/374,793

(22) Filed: Feb. 25, 2003

(65) Prior Publication Data

US 2003/0162443 A1 Aug. 28, 2003

(30) Foreign Application Priority Data

Feb. 25, 2002 (JP) ..... 2002-048208

(51) Int. Cl.[7] ..... H01R 13/66

(52) U.S. Cl. ..... 439/620; 439/188; 439/507; 200/51 R

(58) Field of Search ..... 439/620, 507, 439/509, 188; 200/51.09, 51 R

(56) References Cited

U.S. PATENT DOCUMENTS 5,314,345 A 5/1994 Cahaly et al. ..... 439/188
6,019,622 A * 2/2000 Takahashi et al. ..... 439/188
6,149,448 A * 11/2000 Haller et al. ..... 439/188
6,217,388 B1 * 4/2001 Francis ..... 439/620
6,250,952 B1 6/2001 Shiga et al. ..... 439/466
6,419,510 B2 * 7/2002 Shiraki et al. ..... 439/188
6,544,060 B2 * 4/2003 Wakui et al. ..... 439/188

FOREIGN PATENT DOCUMENTS

EP 512682 A2 11/1992 ..... F42B/3/04
EP 1009070 A2 6/2000 ..... H01R/13/719
EP 1251602 A2 10/2002 ..... H01R/13/703

* cited by examiner

*Primary Examiner*—Truc Nguyen
(74) *Attorney, Agent, or Firm*—Barley Snyder

(57) ABSTRACT

A connector assembly that reduces noise in an igniter system, the connector assembly has a device side connector having a housing with a recess for receiving contacts. A plug connector connected to the device side connector. A shorting assembly provided in the recess between the device side connector and the plug connector. The shorting assembly has a shorting member for shorting the contacts of the device side connector when the device side connector and the plug connector are not connected. A ferrite member is arranged within the shorting assembly and receives the contacts. The ferrite member is positioned proximate a device so that the ferrite member reduces noise in an electrical path that includes the device side connector and the plug connector.

20 Claims, 3 Drawing Sheets

CONNECTOR ASSEMBLY FOR IGNITER SYSTEM AND SHORTING ASSEMBLY

FIELD OF THE INVENTION

The invention relates to a connector assembly. More particularly, the invention relates to a connector assembly for an igniter system including a ferrite member for noise reduction and a shorting assembly utilized thereby.

BACKGROUND OF THE INVENTION

Noise reduction techniques for suppressing noise in electrical paths are well known. For example, with regard to electrical paths that operate air bags used in automobiles to protect passengers during impact, reduction of exterior noise is accomplished by employing noise reduction elements. The noise reduction elements prevent the igniter systems of the air bags from being triggered by noise that may inflate the air bags inadvertently. Ferrite members are commonly provided as noise reduction elements within electrical connectors in these electrical paths.

One example of such a ferrite member for an igniter fuse connector is disclosed in U.S. Pat. No. 6,250,952. The igniter fuse connector mates with a device side connector such as the connector of an air bag. An annular ferrite member (ferrite bead) is arranged around contacts of the igniter fuse connector within an insulative housing thereof to act as a noise reduction element. Additionally, U.S. Pat. No. 5,314,345 discloses a structure wherein a ferrite member (ferrite bead) is arranged around wires within an electrical connector that mates with a device side connector.

With regard to these conventional connectors, the ferrite members are provided in the connector that mates with the device side connector. It is also common for the device side connector to be equipped with a shorting assembly. The shorting assembly shorts the electrical path on the device side connector when the two connectors are not connected so there is no risk that the device side igniter system will malfunction if noise enters the device side electrical path before the two connectors are engaged. However, there is a risk that noise will enter the electrical path between the ferrite member and the igniter system resulting in a malfunction, because the ferrite member is separated from the device along the electrical path.

It is therefore desirable to develop a connector assembly utilizing a shorting assembly wherein the risk of malfunction is reduced by arranging the ferrite member at a position as close as possible to the device to reduce the amount of noise entering the electrical path.

SUMMARY OF THE INVENTION

The invention relates to a connector assembly that reduces noise in an igniter system. The connector assembly has a device side connector having a housing with a recess for receiving contacts. A plug connector is connected to the device side connector. A shorting assembly is provided in the recess between the device side connector and the plug connector. The shorting assembly has a shorting member for shorting the contacts of the device side connector when the device side connector and the plug connector are not connected. A ferrite member is arranged within the shorting assembly and receives the contacts. The ferrite member reduces noise in an electrical path that includes the device side connector and the plug connector.

DETAILED DESCRIPTION OF THE PREFERRED EMBODIMENTS

Figure 1:
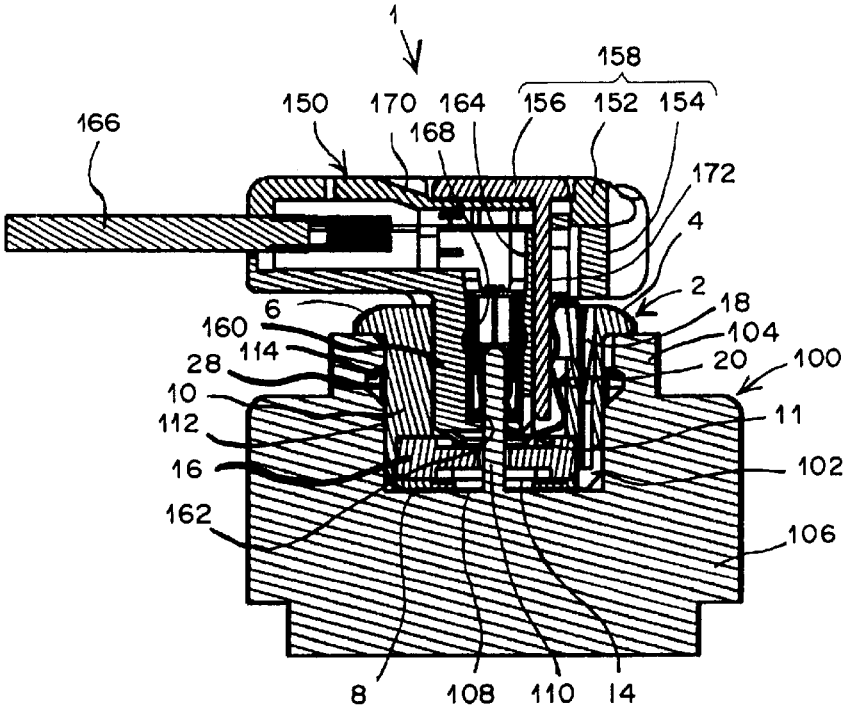
FIG. 1 is a vertical cross-sectional view of a connector assembly.

Hereinafter, a connector assembly 1 for igniter systems will be described in greater detail with reference to the attached drawings. As shown in FIG. 1, the connector assembly 1 has a device side connector 100, a plug connector 150 connected to the device side connector 100, and a shorting assembly 2 such as a shunt ring or Short Circuit Ring (SCR) arranged between the device side connector 100 and the plug connector 150.

The device side connector 100 includes a housing 106 with a recess 102. The recess 102 has a substantially circular cross-section and an annular wall 104 is formed facing outwardly from a periphery of the recess 102. It should be noted that the housing 106 refers only to the vicinity of the engagement portion between the device side connector 100 and the plug connector 150. Pin contacts 110 of the device side connector 100 protrude upward into the recess 102 through a bottom surface 108 thereof. Note that the pin contacts 110 are represented in the same hatching as the housing 106 for the sake of convenience, but are metallic members separate from the housing 106. An annular engagement recess 114 is formed in an interior surface 112 of the recess 102, along a periphery of the interior surface 112.

As shown in FIG. 1, the plug connector 150 includes an insulative housing 158. The insulative housing 158 has an upper housing 152, a lower housing 154, and a Connector Position Assurance Device (CPA) 156. The lower housing 154 has a downwardly protruding engagement protrusion 160. The engagement protrusion 160 is hollow and has openings 162 at a lower edge for receiving pin contacts 110 of the device side connector 100. Substantially L-shaped female contacts 164 are arranged within the hollow portion of the engagement protrusion 160 within the insulative housing 158. Wires 166 are crimped onto free ends of the female contacts 164 to establish electrical connections between the wires 166 and the female contacts 164. The portions of the female contacts 164, which are arranged within the engagement protrusion 160, serve as contact portions 168 for contacting the pin contacts 110.

The lower housing 154 has engagement legs (not shown) for latching with the device side connector 100, when the plug connector 150 engages with the shorting assembly 2. One pair of the engagement legs (not shown) is formed, separated in a direction perpendicular to a surface of the drawing sheet of FIG. 1.

The upper housing 152 has a recess 170. The CPA 156 is mounted in the recess 170. The CPA 156 has tongue pieces (not shown) which are arranged in an interior of the engagement legs (not shown) to support the CPA 156 from interior sides thereof, after the plug connector 150 engages the shorting assembly 2. One pair of tongue pieces (not shown) is formed separated in a direction perpendicular to a surface of the drawing sheet of FIG. 1. The tongue pieces (not shown) positively maintain the engagement state between the plug connector 150 and the device side connector 100. Because this mechanism for maintaining an engaged state is well known, a detailed description thereof will be omitted. Note that the mechanism for maintaining the engagement is similar to the CPA disclosed in Japanese Unexamined Patent Publication No. 2002-47385.

Figure 3:
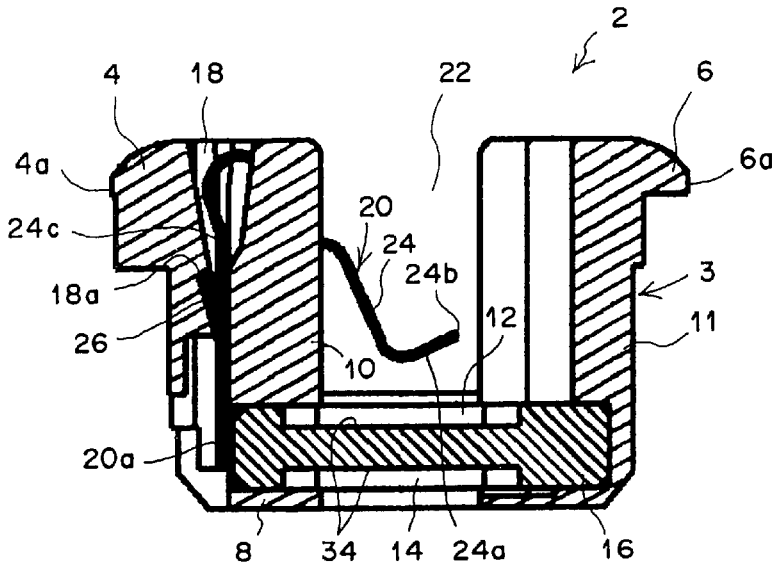
FIG. 3 is a cross-sectional view of the shorting assembly taken along line 3—3 of FIG. 2.
Figure 5:
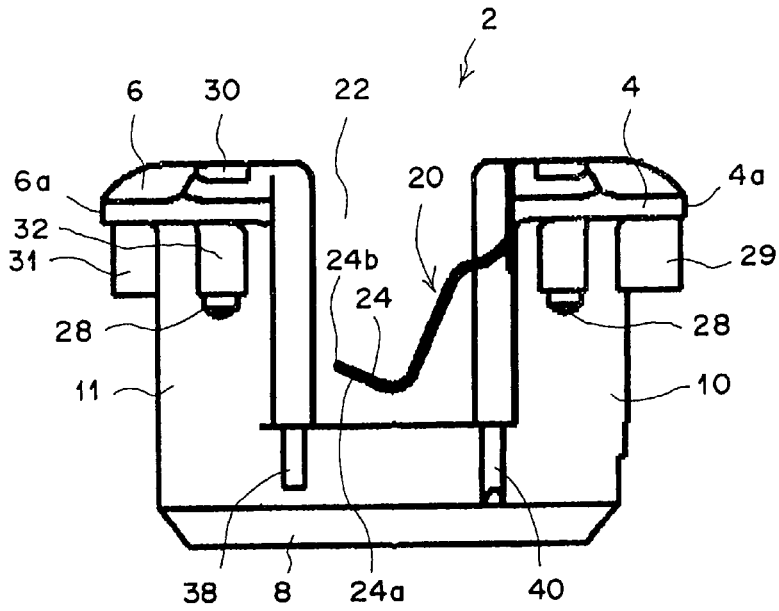
FIG. 5 is a rear view of the shorting assembly of FIG. 2.

As shown in FIG. 3, the shorting assembly 2 includes an insulative housing 3 having an outer form structured to fit within the recess 102 of the device side connector 100. As shown in FIGS. 3 and 5, the insulative housing 3 has a substantially circular bottom wall 8, side walls 10, 11 erected on both sides of the bottom wall 8, and laterally extending flanges 4, 6 formed on upper edges of the side walls 10, 11, respectively. The flanges 4, 6 have arcuate edges 4*a*, 6*a* along the side walls 10, 11, respectively. The side walls 10, 11 define an engagement recess 22 that receives the engagement protrusion 160 of the plug connector 150.

Figure 6:
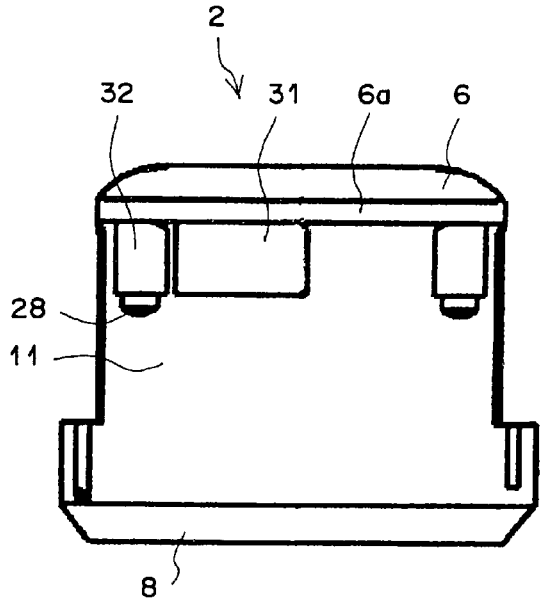
FIG. 6 is a right side view of the shorting assembly of FIG. 2.

As shown in FIGS. 5 and 6, laterally extending engagement protrusions 28 are formed at both ends of each of the side walls 10, 11 along outer peripheries thereof. Openings 30 and grooves 32 to accommodate the formation of the engagement protrusions 28 are formed in the flanges 4, 6 and the side walls 10, 11, respectively. The engagement protrusions 28 secure the shorting assembly 2 by engaging with the engagement recess 114 when the shorting assembly 2 is inserted into the device side connector 100.

As shown in FIG. 5, rotational stop portions 29, 31 are formed on the side walls 10, 11 on lower portions of the flanges 4, 6, respectively. The rotational stop portions 29, 31 have partial cylindrical cross-sections having a smaller radius of curvature than a periphery of the side walls 10, 11. The rotational stop portions 29, 31 engage with recesses (not shown) corresponding thereto within the recess 102. The rotational stop portions 29, 31 prevent the shorting assembly 2 from rotating in a circumferential direction when the shorting assembly 2 is placed within the recess 102 of the device side connector 100.

Figure 2:
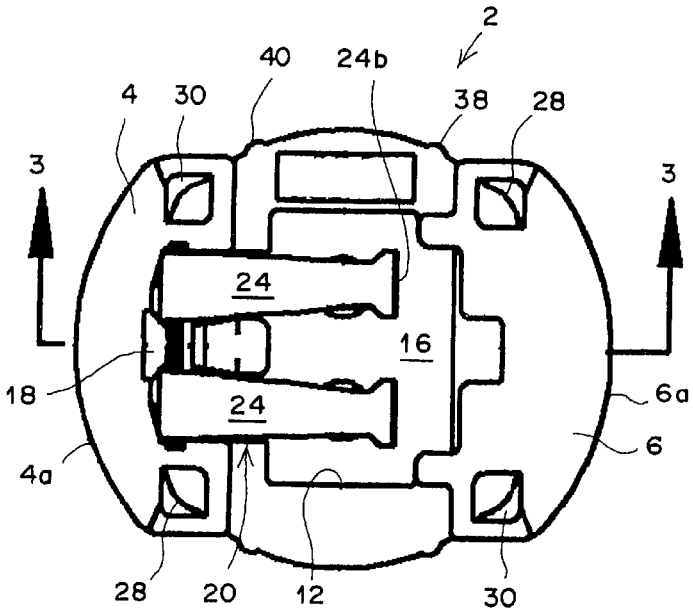
FIG. 2 is a plan view of a shorting assembly utilized by the connector assembly of FIG. 1.

As shown in FIGS. 2 and 5, press fit protrusions 38, 40 that extend in the insertion/extraction direction of the shorting assembly 2 are formed on both sides of the lower end portions of each of the side walls 10, 11. The press fit protrusions 38, 40 are structured as portions of cylinders. The press fit protrusions 38, 40 frictionally engage the inner surface 112 of the recess 102 when the shorting assembly 2 is inserted into the recess 102 of the device side connector 100 so that the shorting assembly 2 is secured within the recess 102 by the engagement protrusions 28 and the press fit protrusions 38, 40.

As most clearly shown in FIG. 3, a space 14 that extends laterally to the side wall 11 and that is open on the side of side wall 10 is formed on the bottom wall 8. An opening 12 is formed above the space 14 and communicates with the space 14. The opening 12 is substantially rectangular when viewed from above and is open in an upward direction.

As shown in FIGS. 2 and 3, a vertically extending contact housing groove 18 is formed in the side wall 10. A downward facing shoulder 18*a*, best shown in FIG. 3, is formed at an approximate midpoint in a vertical direction within the contact housing groove 18. The contact housing groove 18 communicates with the space 14. A shorting contact 20 (shorting member) is arranged within the contact housing groove 18. The shorting contact 20 has two separate contact pieces 24, as best shown in FIG. 2, joined at a base portion 20*a*. As shown in FIG. 3, the base portion 20*a* is inserted into the contact housing groove 18. The contact pieces 24 have support portions 24*c* that rise from the base portion 20*a*. The contact pieces 24 are bent at an upper edge of the contact housing groove 18 so that the contact pieces 24 curve toward the bottom wall 8 within the engagement recess 22. Distal end portions 24*a* of the contact pieces 24 are formed to extend slightly upward. Tips 24*b* of the contact pieces 24 extend beyond the positions corresponding to the pin contacts 110 so that the tips 24*b* of the contact pieces 24 elastically abut the pin contacts 110 when the pin contacts 110 are received in the engagement recess 22. Latch tongue pieces 26 are formed on support portions 24*c* of the contact pieces 24 at positions corresponding to the shoulder 18*a*. The shorting contact 20 is secured within the contact housing groove 18 by the engagement of the latch tongue pieces 26 and the shoulder 18*a*.

Figure 4:
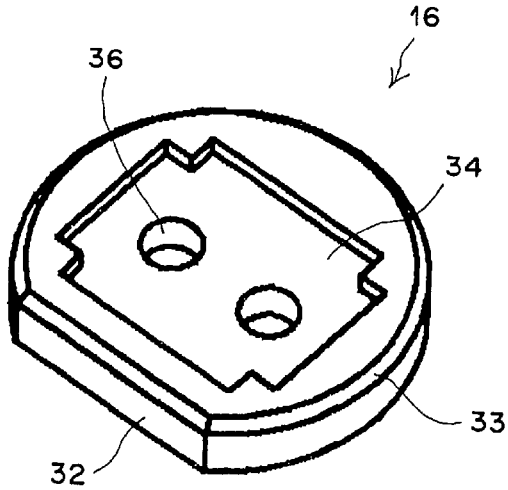
FIG. 4 is a perspective view of a ferrite member utilized by the shorting assembly.

As shown in FIG. 4, the ferrite member 16, which is built into the shorting assembly 2, is of a substantially discoid shape with a portion cut off so as to form a planar surface 32. A bevel 33 is formed along an outer periphery of the ferrite member 16. Substantially rectangular recesses 34 for allowing the tip of the engagement protrusion 160 of the plug connector 150 to escape during engagement of the plug connector 150 with the shorting assembly 2 are formed at a central portion on both sides of the ferrite member 16. The recesses 34 are provided on both sides of the ferrite member 16 so that the ferrite member 16 may be inserted into the space 14 without consideration as to which side is right-side-up to facilitate assembly. A pair of apertures 36 for receipt of the pin contacts 110 is formed within the recesses 34 at positions corresponding to the pin contacts 110.

The method of assembling the connector assembly 1 will now be described. The ferrite member 16 is inserted into the space 14 such that the planar surface 32 is positioned on the side of the side wall 10. The contact pieces 24 are inserted into the contact housing groove 18, and the base portion 20*a* of the shorting contact 20 is positioned at the planar surface 32 so that the base portion 20*a* prevents extraction of the ferrite member 16 and prevents the ferrite member 16 from rotating within the space 14. If the ferrite member 16 rotates within the space 14, the positions of the apertures 36 will change, which will preclude the pin contacts 110 from passing through the apertures 36. Securing the ferrite member 16 in the rotational direction with the base portion 20*a* of the shorting contact 20 serves to avoid such misalignment.

The shorting assembly 2 is inserted into the recess 102 of the device side connector 100 so that the side walls 10, 11 are inserted along the inner surface 112 of the recess 102. During insertion, the side walls 10, 11 flex inwardly due to the engagement protrusions 28. When the engagement protrusions 28 engage with the engagement recess 114, the side walls 10, 11 return outwardly and are fixed within the recess 102. The press fit protrusions 38, 40 are pressed against the inner surface 112 of the recess 102 to establish frictional engagement therewith. The pin contacts 110 protrude from the apertures 36 of the ferrite member 16, while flexing the contact pieces 24, and are positioned within the engagement recess 22 of the shorting assembly 2.

When the plug connector 150 is inserted into the engagement recess 22 to complete engagement, the contact portions 168 of the female contacts 164 contact the pin contacts 110 to establish electrical connections therebetween. At this time, the CPA 156 is not yet pressed into the upper housing 152. The engagement legs (not shown) are in positions perpendicular to the surface of the drawing sheet of FIG. 1 in the engagement recess 22 of the shorting assembly 2. Thereafter, the CPA 156 is pressed into the upper housing 152 from above as shown in FIG. 1. The engagement legs (not shown) are spread toward the exterior of the engagement recess 22 of the shorting assembly 2 by the tongue pieces (not shown) of the CPA 156 to engage the annular engagement recess 114. A tongue piece 172 that extends downward from the CPA 156 flexes the contact pieces 24 of the shorting contact 20. By this flexure, the tips 24*b* of the contact pieces separate from the pin contacts 110, thereby opening the closed circuits and enabling electrical operation of the igniter system.

Because the ferrite member 16 is mounted in the shorting assembly 2 and not in the plug connector 150, the ferrite member 16 is positioned at a location extremely close to the device side connector 100. Therefore, the risk of noise entering the electrical path between the ferrite member 16 and the device side igniter system becomes extraordinarily low. Accordingly, the noise reduction effect is high, and the risk of malfunction of the device is reduced. Further, the ferrite member 16 is arranged at the bottom wall 8 of the shorting assembly 2, which is the closest position to the device. Therefore, the noise reduction effects obtained thereby are further enhanced.

The foregoing illustrates some of the possibilities for practicing the invention. Many other embodiments are possible within the scope and spirit of the invention. For example, in the embodiment described above, the ferrite member 16 was inserted into a molded insulative housing 3. Alternatively, the ferrite member 16 may be insert molded into the insulative housing. It is, therefore, intended that the foregoing description be regarded as illustrative rather than limiting, and that the scope of the invention is given by the appended claims together with their full range of equivalents.

What is claimed is:

1. A connector assembly comprising:

a device side connector having a housing with a recess for receiving contacts;

a plug connector for connecting to the device side connector;

a shorting assembly provided in the recess between the device side connector and the plug connector, the shorting assembly having a shorting member for shorting the contacts of the device side connector when the device side connector and the plug connector are not connected; and a ferrite member arranged within the shorting assembly that receives the contacts, the ferrite member reduces noise in an electrical path through the device side connector and the plug connector.

2. The connector assembly of claim 1, wherein the ferrite member is built into the shorting assembly.

3. The connector assembly of claim 1, wherein the ferrite member is arranged on a bottom wall of the shorting assembly proximate a device.

4. The connector assembly of claim 1, wherein each contact is received in an aperture formed in the ferrite member.

5. The connector assembly of claim 1, wherein the shorting assembly includes an engagement protrusion that engages with an opening in the housing to attach the shorting assembly to the device side connector.

6. The connector assembly of claim 1, wherein the shorting assembly includes press-fit protrusions that engage a surface of the recess to secure the shorting assembly within the recess.

7. The connector assembly of claim 1, wherein the shorting member includes a base portion that abuts the ferrite member to prevent the ferrite member from becoming displaced.

8. The connector assembly of claim 1, wherein the shorting assembly includes stop portions that engage with the recess to prevent the shorting assembly from rotating within the recess.

9. The connector assembly of claim 1, wherein the ferrite member has a cut-out that receives an engagement protrusion of the plug connector to facilitate mating of the plug connector with the shorting assembly.

10. The connector assembly of claim 9, wherein the cut-out is formed on a top side and a bottom side of the ferrite member to facilitate assembly.

11. A shorting assembly comprising:

an insulative housing having a bottom wall and side walls;

a shorting member for shorting contacts of a first connector and a second connector before the first connector and the second connector are connected; and a ferrite member arranged within the housing in a recess between the first connector and the second connector so that the ferrite member is positioned proximate a device to reduce noise in an electrical path through the first connector and the second connector.

12. The shorting assembly of claim 11, wherein the ferrite member is built into the housing.

13. The shorting assembly of claim 11, wherein the ferrite member is arranged on the bottom wall of the housing.

14. The shorting assembly of claim 11, wherein the ferrite member has apertures for receiving the contacts.

15. The shorting assembly of claim 11, wherein the housing includes an engagement protrusion to attach the housing to the first connector.

16. The shorting assembly of claim 11, wherein the housing includes press-fit protrusions to secure the housing to the first connector.

17. The shorting assembly of claim 11, wherein the shorting member includes a base portion that abuts the ferrite member to prevent the ferrite member from becoming displaced.

18. The shorting assembly of claim 11, wherein the housing includes stop portions to prevent the housing from rotating relative to the first connector.

19. The shorting assembly of claim 11, wherein the ferrite member has a cut-out for receiving an engagement protrusion of the second connector to facilitate mating the second connector with the shorting assembly.

20. The shorting assembly of claim 19, wherein the cut-out is formed on a top side and a bottom side of the ferrite member to facilitate assembly.

* * * * *